US005707269A

United States Patent [19]

Murphy

[11] Patent Number: 5,707,269

[45] Date of Patent: Jan. 13, 1998

[54] DETACHABLE CHILD'S TOY

[76] Inventor: Patricia Murphy, 432 Wilmerton St., Beverly, N.J. 08010

[21] Appl. No.: 649,084

[22] Filed: May 17, 1996

[51] Int. Cl.[6] ..... A63H 3/00; A63H 33/04

[52] U.S. Cl. ..... 446/268; 446/75; 446/901

[58] Field of Search ..... 446/75, 268, 901, 446/73, 72, 85, 125, 1.2, 115, 3.61

[56] References Cited

U.S. PATENT DOCUMENTS

| | | | |
|---|---|---|---|
| 296,941 | 4/1884 | Diener . | |
| 312,420 | 2/1885 | Anderson | 446/85 X |
| 782,817 | 2/1905 | Beiser | 446/75 X |
| 1,273,605 | 7/1918 | Goldman | 446/73 X |
| 3,406,816 | 10/1968 | Green et al. | 446/73 |
| 3,726,027 | 4/1973 | Cohen et al. . | |
| 3,924,376 | 12/1975 | Tsurumi | 446/115 X |
| 4,365,454 | 12/1982 | Davis | 446/112 X |
| 4,543,278 | 9/1985 | Ackerman | 446/901 X |
| 4,591,345 | 5/1986 | Kohner | 446/361 |
| 4,808,139 | 2/1989 | Price | 446/75 |
| 4,861,305 | 8/1989 | Wilson | 446/75 |
| 4,978,301 | 12/1990 | Dodge . | |
| 5,098,328 | 3/1992 | Beerens | 446/125 X |
| 5,330,379 | 7/1994 | Roh et al. | 446/901 X |
| 5,332,093 | 7/1994 | Littlepage | 446/73 X |
| 5,340,348 | 8/1994 | Schroeder | 446/901 X |
| 5,458,522 | 10/1995 | Brooks, III . | |
| 5,498,188 | 3/1996 | Deahr | 446/901 X |

FOREIGN PATENT DOCUMENTS

| | | | |
|---|---|---|---|
| 0512760 | 11/1992 | European Pat. Off. | 446/75 |
| 1913383 | 9/1970 | Germany | 446/115 |
| 094006528 | 3/1994 | WIPO | 446/115 |

*Primary Examiner*—D. Neal Muir
*Attorney, Agent, or Firm*—Norman E. Lehrer

[57] ABSTRACT

A child's toy which includes a plurality of detachable planar wall members. Each of the wall members has an exterior surface, an interior surface, and a plurality of side edges. The side edges define four corners. A plurality of VELCRO hook and loop type fastening strips are secured to each of the wall members. Each of the hook and loop type fastening strips on the wall members is adapted to mate with a complementary loop and hook type fastening strip on a different wall member in order to secure the wall members together. The child's toy includes at least one three dimensional toy figure releasably fastened to the interior surface of one of the wall members.

7 Claims, 1 Drawing Sheet

DETACHABLE CHILD'S TOY

BACKGROUND OF THE INVENTION

The present invention relates generally to a child's toy and, more particularly, to such a toy which has detachable walls with three dimensional figures removably secured thereto.

Young children often enjoy assembling and dismantling objects. A popular amusement device with children has been a construction set which includes a number of attachable pieces. Most existing construction sets are not suitable for very young children as they contain numerous small rigid pieces, the assembly of which requires more coordination than possessed by such children. Additionally, such construction sets typically pose a severe safety hazard for young children as the small pieces can be placed in their mouths and swallowed.

In recognition of the foregoing, some construction sets have been proposed which include relatively large pieces which are removably secured to one another by VELCRO® type fastening strips. For example, U.S. Pat. No. 5,458,522 to Brooks, III discloses a plurality of building blocks having VELCRO type fastening strips secured to the side edges thereof. However, since the blocks are rigid, injuries or accidents may be caused by young children stepping on or throwing the blocks.

U.S. Pat. No. 4,978,301 to Dodge discloses an educational construction set having a number of semi-rigid pieces which are secured together by VELCRO® strips. While the individual pieces may be of a sufficient size and flexibility to avoid injuring young children, the individual pieces have a variety of shapes and sizes and must be attached in a very specific manner to obtain the desired structure. Accordingly, young children and toddlers may encounter difficulty in properly assembling the pieces.

SUMMARY OF THE INVENTION

The present invention is designed to overcome the deficiencies of the prior art discussed above. It is an object of the present invention to provide a child's toy which can be readily assembled and disassembled.

It is a further object of the invention to provide such a toy which is safe for very young children.

It is yet another object of the invention to provide a toy that will consistently hold the attention of the child.

In accordance with the illustrative embodiments, demonstrating features and advantages of the present invention, there is provided a child's toy which includes a plurality of detachable planar wall members. Each of the wall members has an exterior surface, an interior surface, and a plurality of side edges. The side edges define four corners. A plurality of VELCRO hook and loop type fastening strips are secured to each of the wall members. Each of the hook and loop type fastening strips on the individual wall members is adapted to mate with a complementary loop and hook type fastening strip on a different wall member in order to secure the wall members together. The child's toy includes at least one three dimensional toy figure releasably fastened to the interior surface of one of the wall members.

Other objects, features and advantages of the invention will be readily apparent from the following detailed description of a preferred embodiment thereof taken in conjunction with the drawings.

BRIEF DESCRIPTION OF THE DRAWINGS

For the purpose of illustrating the invention, there is shown in the accompanying drawings one form which is presently preferred; it being understood that the invention is not intended to be limited to the precise arrangements and instrumentalities shown.

DETAILED DESCRIPTION OF THE PREFERRED EMBODIMENT

Figure 1:
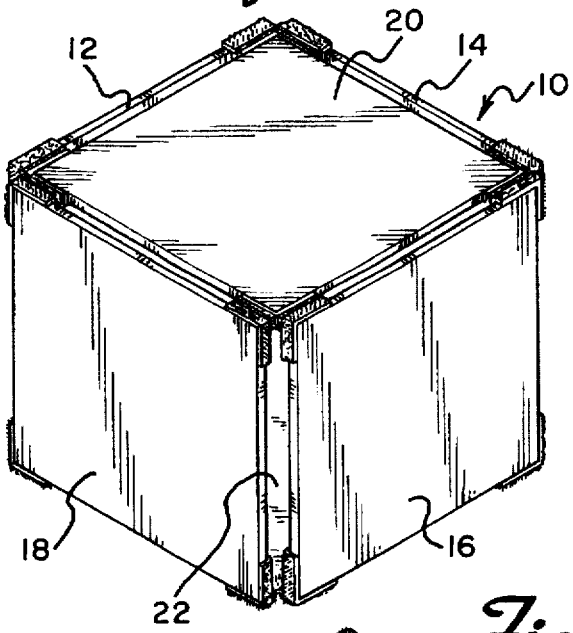
FIG. 1 is a perspective view of the present invention.

Referring now to the drawings in detail wherein like reference numerals have been used throughout the various figures to designate like elements, there is shown in the figures a child's toy constructed in accordance with the principles of the present invention and designated generally as 10.

The child's toy 10 preferably includes six wall members 12, 14, 16, 18, 20 and 22. Each wall member is substantially identical to the other wall members. Accordingly, only one of the wall members will be described in detail, it being understood that the description applies equally to the other wall members. Wall member 22 includes an exterior surface 24 and an interior surface 26. The wall member 22 has four side edges 28*a,b,c,d* which define corners 30*a,b,c,d*. The preferred shape for each wall member is square and the preferred material is a semi-rigid fabric. However, the wall members can be comprised of other materials such as plastic and wood.

Figure 2:
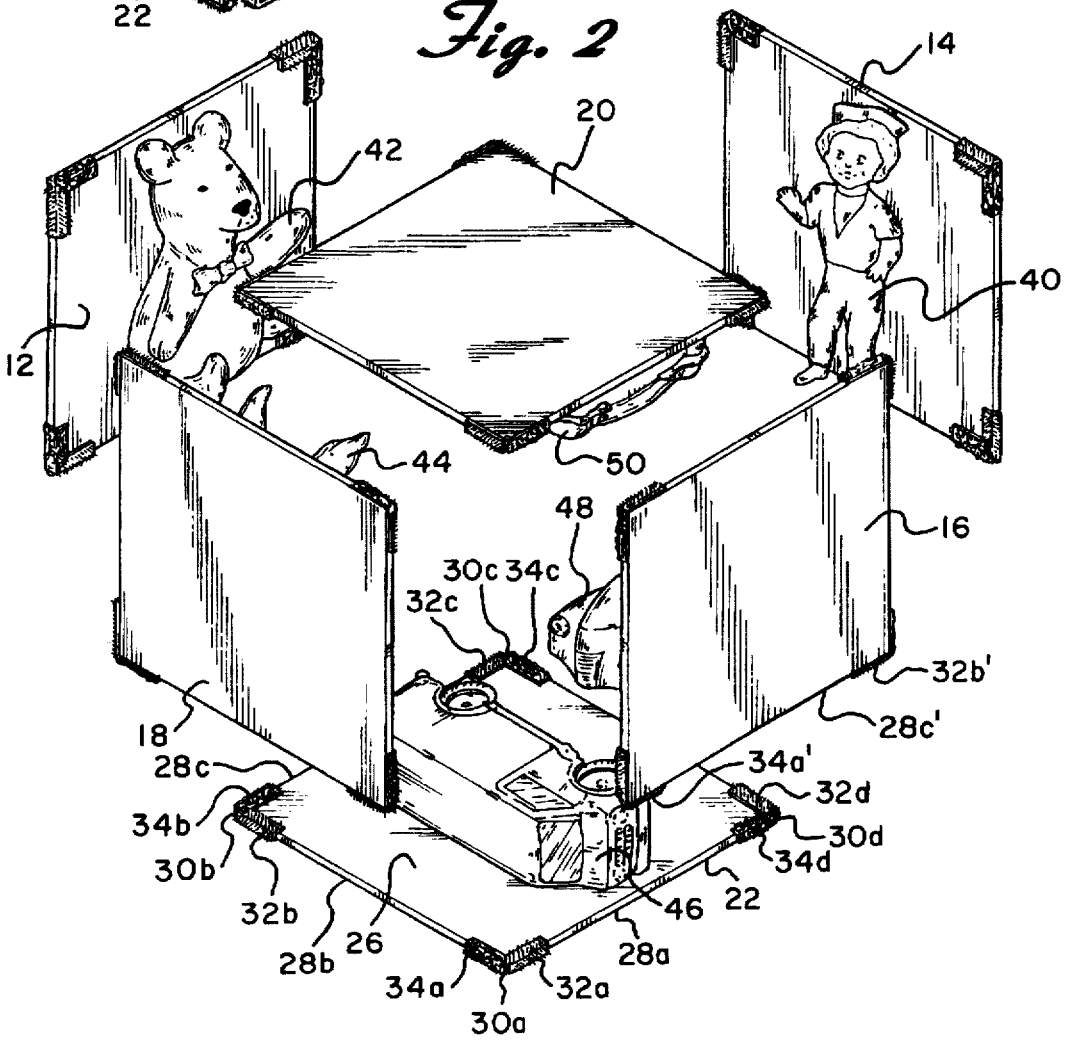
FIG. 2 is an exploded perspective view of the present invention.

In the preferred embodiment, releasable securing means in the form of VELCRO hook and loop fastening strips (VELCRO is a registered trademark owned by Velcro USA) are secured adjacent the corners 30*a,b,c,d* of the wall member 22. More specifically, a hook type fastening strip 32*a* is secured to the interior surface 26 and the side edge 28*a* of the wall member 22 adjacent the corner 30*a*. A loop type fastening strip 34*a* is also secured to the interior surface 26 and the side edge 28*b* of the wall member 22 adjacent the corner 30*a*. The hook and loop type fastening strips 32*a* and 34*a* preferably extend at a 90° from one another. VELCRO hook and loop type fastening strips 32*b*, 34*b*, 32*c*, 34*c* and 32*d*, 34*d* are similarly secured adjacent each of the remaining corners 30*b*, 30*c* and 30*d* (FIG. 2). In order to place the toy in the assembled condition, as shown in FIG. 1, each of the wall members are secured to one another by mating hook type fastening strips with complementary loop type fastening strips as more fully described below.

Figure 3:
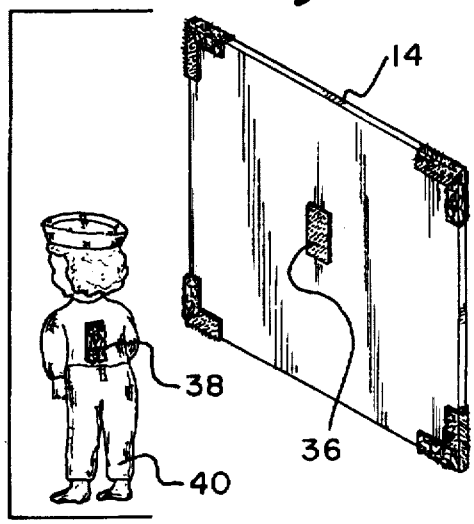
FIG. 3 is a perspective view of a panel with a three dimensional figure shown detached therefrom.

Referring to FIG. 3, the wall member 14 has an additional hook type fastening strip 36 secured to the center of the interior surface thereof. The hook type fastening strip 36 is adapted to mate with a loop type fastening strip secured to the back of a three dimensional toy. For example, in FIG. 3, a loop type fastening strip 38 is shown secured to the back of a three dimensional toy doll 40. In the preferred embodiment, each of the wall members has an additional hook type fastening strip secured to the interior surface thereof. It should be readily apparent that a variety of toy figures could be releasably mated with each of the loop type fastening strips on the wall members 12, 14, 16, 18, 20 and 22. For example, a toy bear 42, a toy rabbit 44, a toy truck 46, and toy cars 48 and 50 are shown releasably secured to corresponding wall members (FIG. 2). When the toy 10 is placed in its assembled condition as shown in FIG. 1, the toy figures 40, 42, 44, 46, 48 and 50 are completely hidden from view.

In order to facilitate an understanding of the principles associated with the foregoing apparatus its operation will now be briefly described. The child's toy 10 is placed in its assembled condition as illustrated in FIG. 1. This is accomplished by mating hook type fastening strips to corresponding loop type fastening strips. By way of example, hook type fastening strip 32*a* on the interior surface 26 of the wall member 22 is mated with loop type fastening strip 34*a*' on the side edge 28*c*' of the wall member 16. Similarly, loop type fastening strip 34*d* on the interior surface 26 of wall member 22 is mated with hook type fastening strip 32*b*' on the side edge 28*c*' of the wall member 16. Accordingly, the wall member 22 extends perpendicularly from the wall member 16. The remaining wall members are similarly secured to one another.

In use, a child pulls individual wall members from the toy 10 to reveal the toy figure secured to the inside surface thereof. The child can then remove the toy figure from the individual wall member by pulling the figure therefrom. It should be readily apparent that the child can replace a toy figure from one wall member and replace it with a different toy figure since each toy figure has a loop type fastening strip secured thereto which is adapted to mate with a complementary hook type fastening strip located on the center of each of the wall members. It should also be apparent that the size and placement of the VELCRO hook and loop type fastening strips can be changed.

The present invention may be embodied in other specific forms without departing from the spirit or essential attributes thereof and accordingly reference should be made to the appended claims rather than to the foregoing specification as indicating the scope of the invention.

What is claimed is:

1. A child's toy comprising:

six substantially planar wall members, each of said wall members being substantially in the shape of a square and having an exterior surface and an interior surface, each of said wall members further having four side edges and being capable of being arranged in the form of a substantially closed cube with said side edges defining the eight corners of said cube;

a plurality of means for releasable securing each of said wall members to one another, said securing means being secured to said side edges and to a portion of said interior surface of said wall members;

at least one three dimensional toy figure, and means for fastening said toy figure to said interior surface of one of said wall members.

2. The child's toy of claim 1 wherein each of said wall members is comprised of a semi-rigid material.

3. The child's toy of claim 1 wherein each of said securing means includes a plurality of hook type fastening strips and a plurality of loop type fastening strips, each of said hook and loop type fastening strips being secured to said side edges of a corresponding one of said wall members and to said interior surface of said corresponding one of said wall members.

4. The child's toy of claim 1 wherein each of said securing means includes a plurality of hook type fastening strips and a plurality of loop type fastening strips, each of said hook and loop type fastening strips being secured adjacent each of said corners of a corresponding one of said wall members.

5. The child's toy of claim 1 wherein said fastening means includes one of a loop and hook type fastening strip secured to said interior surface of said wall member and a complementary one of said loop and hook type fastening strip secured to said toy figure.

6. The child's toy of claim 1 including a plurality of three dimensional toy figures and means for fastening said plurality of toy figures to said interior surfaces of a plurality of said wall members.

7. The child's toy of claim 6 including six three dimensional toy figures and means for fastening said toy figures to each of said interior surfaces of said six wall members.

* * * * *